US005752596A

United States Patent [19]

Chu

[11] Patent Number: 5,752,596

[45] Date of Patent: May 19, 1998

[54] SIDE OPERATED KEY ACTUATOR

[75] Inventor: Pak-Jong Chu, Nepean, Canada

[73] Assignee: Northern Telecom Limited, Montreal, Canada

[21] Appl. No.: 681,504

[22] Filed: Jul. 23, 1996

[51] Int. Cl.[6] ..... H01H 13/70

[52] U.S. Cl. ..... 200/343; 200/330

[58] Field of Search ..... 200/331, 341, 200/343, 529, 330, 332

[56] References Cited

U.S. PATENT DOCUMENTS

| | | | |
|---|---|---|---|
| 3,777,092 | 12/1973 | Yeske | 200/172 |
| 4,368,364 | 1/1983 | Harbers, Jr. | 200/6 |
| 4,389,549 | 6/1983 | Brown | 200/5 |
| 4,394,555 | 7/1983 | Long et al. | 200/343 |
| 4,447,681 | 5/1984 | Desmarais | 200/5 |
| 4,816,631 | 3/1989 | Yamashita et al. | 200/332 |
| 4,877,925 | 10/1989 | Kobayashi | 200/343 |
| 5,132,498 | 7/1992 | Lee | 200/529 |

FOREIGN PATENT DOCUMENTS 1239179 7/1988 Canada .

*Primary Examiner*—David J. Walczak
*Attorney, Agent, or Firm*—Foley & Lardner

[57] ABSTRACT

An electronic device is formed with a casing which houses a printed circuit board carrying a surface mounted switch. The casing has a hole through which a push-button portion of a switch actuator projects for operation by the thumb of a user. Because of design considerations the push-button portion has to be located approximately on the same plane as the printed circuit board. Accordingly the actuator has to be designed to convert inward motion of the push-button to motion in a direction perpendicular to the push-button motion so as to operate the switch. This is achieved by forming the actuator as a hook having a free end for engaging the switch and another end joined to the push-button and formed as a pivot.

8 Claims, 1 Drawing Sheet

SIDE OPERATED KEY ACTUATOR

FIELD OF THE INVENTION

This invention relates to switches and is particularly concerned with an actuator for a switch.

BACKGROUND OF THE INVENTION

Frequently in the electronic industry, it is desirable to mount a switch directly on a printed circuit board to eliminate costly interconnections and mounting features.

The conventional switch is designed to be operated in a direction normal to the printed circuit board by means of an actuator such as a simple push-button actuator whereby the actuator is simply pushed directly forward in a direction towards the switch. Where the push-button can be placed directly in line with the switch, this does not present a problem. However, where the push-button cannot be placed directly in line with the switch, alternative designs must be developed. Such designs will be necessary where, for example, a switch is mounted on a printed circuit board but a button of a push-button actuator must be located edge-on to the printed circuit board.

One conventional solution to the problem is to replace the conventional switch with a custom switch module which is placed edge on to the printed circuit board and which makes electrical connection to the board by means of fly leads. This solution permits a push-button actuator to be used but requires a custom switch module rather than the less expensive conventional switch module. Moreover, it takes up more space in a direction in which space may be at a premium.

Various types of actuators for switches are known where a force applied in one direction to one portion of an actuator effects, on another portion of the actuator, a force in another direction causing a change to a state of a switch. For example, U.S. Pat. No. 4,816,631 issued to Yamashita on Mar. 23, 1989 describes an actuator in which a vertical force applied to a lever portion of an actuator causes another portion of the actuator to effect a change to a slide switch in a horizontal direction. This, and similar devices, work well for slide switches but are not well adapted to switches. As well, for practical and aesthetic reasons, it is often desirable or necessary to use a push-button actuator rather than a lever-type actuator.

SUMMARY OF THE INVENTION

Accordingly, it is an object of an aspect of the present invention to provide a push-button actuator which is capable of operating a switch module aligned at an angle, for example 90°, to the push-button of the actuator.

It is a further object of the present invention to provide such an actuator which is simple, reliable and effective.

In accordance with an aspect of the present invention there is provided an actuator for depressing a switch, the actuator comprising: (a) a first portion having a first free end and a second end; (b) a pivot means incorporated into the first portion and located at the second end to permit the free end to pivot along an arc; (c) a second portion formed as a push-button projecting from the first portion in a direction away from the free end and at a location proximate the pivot means; and (d) support means for pivotally engaging the pivot means; whereby a force applied to the push-button causes movement of the free end of the first portion in a direction different from the applied force.

More particularly, the invention provides an electronic device comprising a housing enclosing electronic components among which is a printed circuit board having a switch mounted on a surface of the printed circuit board, the electronic device further comprising a manually operable actuator for the switch, the actuator comprising: (a) a first portion having a first free end engageable with the switch and a second end; (b) a pivot means incorporated into the first portion and located at the second end to permit the free end to pivot along an arc; (c) a second portion formed as a push-button connected to the first portion and protecting outwardly through a hole in the casing away from the free end and at a location proximate the pivot means; and (d) support means formed on inside surface of the casing for pivotably engaging the pivot means; whereby a force applied to the push-button causes movement of the free end of the first portion in a direction different from the applied force to actuate the switch.

The first actuator portion is preferably formed as a hook portion.

BRIEF DESCRIPTION OF DRAWINGS

The present invention will now be described in detail with reference to the accompanying drawings in which like numerals denote like parts in the several views and in which.

DETAILED DESCRIPTION

Figure 1:
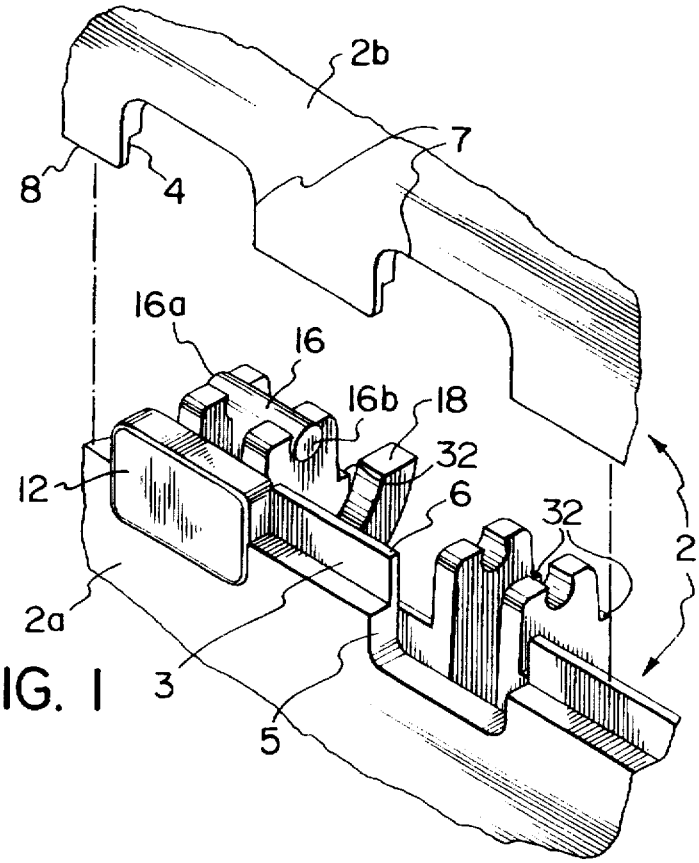
FIG. 1 is a perspective view, partly exploded, of a housing of an electronic device showing a switch actuator mounted therein.

With reference to FIG. 1, a housing 2 of an electronic device such as a telephone headset comprises a bottom housing half **2*a* and a complementary top housing half 2*b*** made of molded plastics material and designed to fit together in known fashion to encompass therein electronic components including a printed circuit board.

The bottom housing half **2*a* has a recessed portion 3 on its outer surface and the top housing half 2*b* has a recessed portion 4** on its inner surface whereby, when the two housing halves are brought together the two recessed portions come into registry with each other and provide an overlapping joint.

The bottom housing half **2*a* has two spaced generally rectangular windows 5, only the right hand one of which can be clearly seen in FIG. 1, opening onto the upper edge 6 of the bottom housing half. The top housing half 2*b* is provided with two complementary windows 7 opening onto the lower edge 8 of the top housing half. When the two housing halves are brought together the windows 7 respectively register with the windows 5 to define two rectangular holes in each of which is located a portion of a respective switch actuator 10 which will be described with reference to FIGS. 2 and 3 in conjunction with FIG. 1. For clarity, the right hand switch actuator has been omitted from FIG. 1, this being the left hand one in FIG. 2**.

Figure 2:
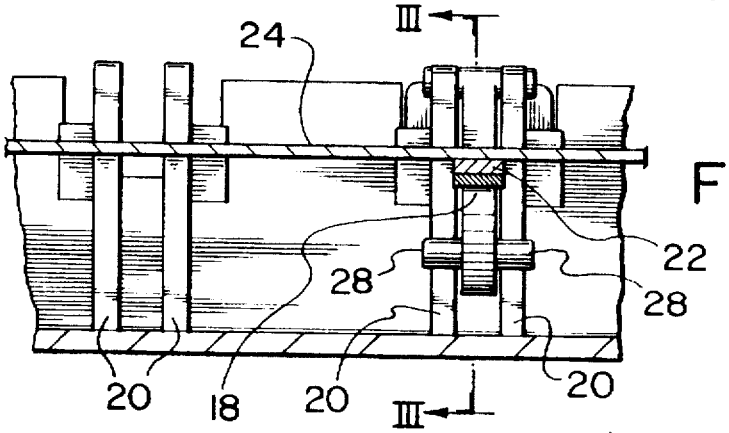
FIG. 2 is an elevational view of the inside of the bottom half of the housing showing the actuator cooperating with a switch mounted on a printed circuit board.

The actuator 10 is formed of a single piece of molded plastics material and comprises a push-button portion 12, a hook portion 14, a pivot pin 16 and a free end 18. Hook portion 14 is generally planar. Free end 18 is located at one end of hook portion 14 and is generally flat to effectively engage a switch module 22 mounted on the underside of a printed circuit board 24 (FIG. 2). Pivot pin 16 is located at the other end of hook portion 14, is oriented perpendicular to the plane of hook portion 14, and is formed of two trunnions 16*a* and 16*b* which project one on either side of the plane of hook portion 14. Push-button portion 12 projects rearwardly from hook portion 14 and is connected to hook portion 14, via connection portion 15, at a location below pivot pin 16. Pivot pin 16 is pivotally supported by engagement of the trunnions 16*a* and 16*b* in two U-shaped portions 26 respectively formed in vertical ribs 20, integrally formed on the inside surface of the bottom housing half 2*a*. As can be seen in FIGS. 1 and 2, a pair of the ribs 20 is located in registry with each window 5. Each U-shaped portion 26 comprises two prongs 27. The distance between the upper portions of the prongs 27 is slightly less than the distance between the lower portions of the prongs 27 and the diameter of pivot pin 16, allowing pivot pin 16 to snap into the U-shaped portion 26.

Ribs 20 extend the height of the hook portion 14 to help guide actuator 10. Hook portion 14 further comprises two detents 28, which project from near the bottom of hook portion 14, perpendicular to the plane of hook portion 14. One detent 28 projects from one side of hook portion 14 and the other detent 28 projects from the other side of hook portion 14. Engagement of the detents 28 with inner edges 30 of the ribs 20 limit rearward movement (clockwise as seen in FIG. 3) of actuator 10.

Figure 3:
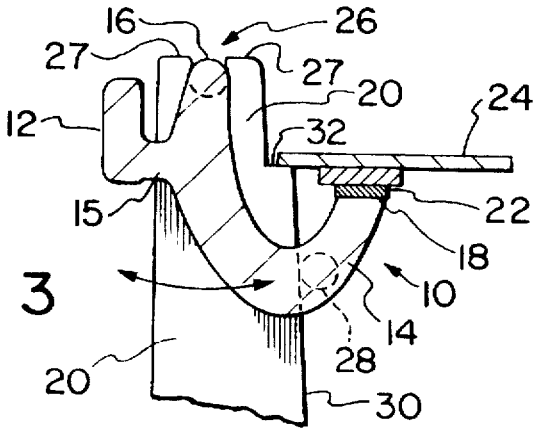
FIG. 3 is a sectional view taken on line III—III of FIG. 2 and illustrating the actuator in greater detail.

Each rib 20 is provided with a step 32, seen clearly in FIG. 3, located on the inner edge 30 at a location approximately at the same level as push-button portion 12. The printed circuit board 24 rests on the steps 32 and, as seen in FIGS. 2 and 3, a switch 22 is attached to the under-surface of the printed circuit board 24. The switch 22 is inherently spring biased in a downward direction to an open position. As can be seen in FIG. 2, the push-button 12 is substantially coplanar with the printed circuit board 24.

During use of actuator 10, when push-button portion 12 is pushed, actuator 10 pivots about pivot pin 16, causing free end 18 to move upwardly and actuate switch 22. When push-button 12 is released, the biasing force in switch 22 returns actuator 10 to its original position.

Numerous modifications, variations, and adaptations may be made to the particular embodiments of the invention described above without departing from the scope of the invention as defined in the claims.

For example, instead of pivot pin 16, the actuator 10 could include other pivot means such as opposing indentations in the shaft portion of actuator 10 which could be pivotally connected to ribs 20 by corresponding prongs formed in the ribs 20 to engage the indentations.

As well, the shape and orientation of hook portion 14 can be modified as appropriate, depending upon the relative placement of switch 22 to push-button portion 12. In a case where the printed circuit board is not aligned in a plane parallel to the direction of operation of the push-button portion, the free end 18 of the actuator will be arranged to move in a direction other than 90° with respect to the direction of operation of the push-button. Also, by relocating pivot pin 16, other configurations of actuator 10 are possible affecting the distance travelled by the free end of the actuator and the resulting switching force.

I claim:

1. An actuator for depressing a switch, the actuator comprising:

(a) a first planar portion disposed within a plane and having a first free end, a second end and a lowermost portion between the first and second ends;

(b) a pivot pin oriented perpendicular to the plane of the planar portion incorporated into the first portion and located at the second end to permit the free end to pivot along an arc;

(c) a second portion formed as a push-button projecting from the first portion in a direction away from the free end and at a location proximate the pivot pin;

(d) support means for pivotally engaging the pivot pin;

whereby a force applied to the push-button causes movement of the free end of the first portion in a direction different from the applied force;

the support means comprising two ribs, each rib comprising a "U"-shaped portion wherein the "U"-shaped portions pivotally support the pivot pin on either side of the first portion and the ribs extend below the lowermost portion of the first portion on either side thereof to serve as a guide for the first portion; and (e) detent means formed on the first portion for engagement with an edge of a rib to limit movement of the first portion in a direction opposite to the applied force.

2. An actuator for depressing a switch, the actuator comprising:

(a) a planar hook portion disposed within a plane and having a first free end, a second end and a lowermost portion between the first and second ends;

(b) a pivot pin oriented perpendicular to the plane of the hook portion incorporated into the hook portion and located at the second end to permit the free end to pivot along an arc;

(c) a push-button portion projecting from the hook portion in a direction away from the free end and at a location proximate the pivot pin;

(d) support means for pivotally engaging the pivot pin;

whereby a force applied to the push-button portion causes movement of the free end of the hook portion in a direction different from the applied force;

the support means comprising two ribs, each rib comprising a "U"-shaped portion wherein the "U"-shaped portions pivotally support the pivot pin on either side of the hook portion and the ribs extend below the lowermost portion of the hook portion on either side thereof to serve as a guide for the hook portion; and (e) detent means formed on the hook portion for engagement with an edge of a rib to limit movement of the hook portion in a direction opposite to the applied force.

3. An actuator according to claim 2, wherein the free end is arranged to move substantially perpendicularly with respect to a force applied to the push-button portion.

4. An actuator for operating a switch mounted on a surface of a printed circuit board enclosed in a housing of an electronic device, the actuator comprising:

(a) a planar hook portion disposed within a plane and having a first free end engageable with the switch, a second end and a lowermost portion between the first and second ends;

(b) a pivot pin oriented perpendicular to the plane of the hook portion incorporated into the hook portion and located at the second end to permit the free end to pivot along an arc;

(c) a push-button portion projecting from the hook portion out of the housing in a direction away from the free end and at a location proximate the pivot pin;

(d) support means on the housing for pivotally engaging the pivot pin;

whereby a force applied to the push-button portion causes movement of the free end of the hook portion in a direction different from the applied force thereby to activate the switch;

the support means comprising two ribs, each rib comprising a "U"-shaped portion wherein the "U"-shaped portions pivotally support the pivot pin on either side of the hook portion and the ribs extend below the lowermost portion of the hook portion on either side thereof to serve as a guide for the hook portion; and (e) detent means formed on the hook portion for engagement with an edge of a rib to limit movement of the hook portion in a direction opposite to the applied force.

5. An actuator according to claim 4 in which the support means further includes a shoulder for supporting the surface of the printed circuit board on which the switch is mounted, the shoulder being substantially aligned with the push-button portion.

6. An electronic device comprising a housing enclosing electronic components among which is a printed circuit board having a switch mounted on a surface of the printed circuit board, the electronic device further comprising a manually operable actuator for the switch, the actuator comprising:

(a) a first planar portion disposed within a plane and having a first free end engageable with the switch, a second end and a lowermost portion between the first and second ends;

(b) a pivot pin oriented perpendicular to the plane of the planar portion incorporated into the first portion and located at the second end to permit the free end to pivot along an arc;

(c) a second portion formed as a push-button connected to the first portion and projecting outwardly through a hole in the housing away from the free end and at a location proximate the pivot pin;

(d) support means formed on inside surface of the housing for pivotably engaging the pivot pin;

whereby a force applied to the push-button portion causes movement of the free end of the first portion in a direction different from the applied force to activate the switch;

the support means comprising two ribs, each rib comprising a "U"-shaped portion wherein the "U"-shaped portions pivotally support the pivot pin on either side of the first portion and the ribs extend below the lowermost portion of the first portion on either side thereof to serve as a guide for the first portion; and (e) detent means formed on the first portion for engagement with an edge of a rib to limit movement of the first portion in a direction opposite to the applied force.

7. An electronic device according to claim 6, wherein the push-button lies in a plane parallel to the printed circuit board and the free end of the first portion is arranged to move substantially perpendicularly with respect to a force applied to the push-button.

8. An electronic device according to claim 6, wherein the push-button and the printed circuit board are substantially coplanar and the free end of the first portion is arranged to move substantially perpendicularly with respect to a force applied to the push-button.

* * * * *